US005617606A

United States Patent [19]

Scott, II et al.

[11] Patent Number: 5,617,606

[45] Date of Patent: Apr. 8, 1997

[54] FLUTED SWIMMING POOL CLEANER DISCS

[75] Inventors: James D. Scott, II, Boca Raton; William W. Stone; William T. Clark, both of Coral Springs; Chris A. Rice, Boca Raton, all of Fla.

[73] Assignee: Baracuda International Corp., Ft. Lauderdale, Fla.

[21] Appl. No.: 608,703

[22] Filed: Feb. 29, 1996

[51] Int. Cl.[6] ..... E04H 4/16

[52] U.S. Cl. ..... 15/246; 15/1.7

[58] Field of Search ..... 15/1.7, 246

[56] References Cited

U.S. PATENT DOCUMENTS

| | | | |
|---|---|---|---|
| 2,215,377 | 9/1940 | Penfield et al. . | |
| 2,263,774 | 11/1941 | Heltzel et al. . | |
| 2,275,190 | 3/1942 | Lowry . | |
| 2,392,146 | 1/1946 | Hall . | |
| 2,809,387 | 10/1957 | Paiso . | |
| 3,046,583 | 7/1962 | Drennan | 15/1.7 |
| 3,243,830 | 4/1966 | Conrad | 15/1.7 |
| 3,273,187 | 9/1966 | Williams | 15/1.7 |
| 3,902,215 | 9/1975 | Waldrop, et al. . | |
| 4,095,378 | 6/1978 | Urakami . | |
| 4,152,802 | 5/1979 | Chauvier . | |
| 4,193,156 | 3/1980 | Chauvier | 15/1.7 |
| 4,193,469 | 3/1980 | Graf . | |
| 4,351,077 | 9/1982 | Hofmann | 15/1.7 |
| 4,530,125 | 7/1985 | Hofmann . | |
| 4,642,833 | 2/1987 | Stoltz et al. . | |
| 4,742,593 | 5/1988 | Kallenbach . | |
| 4,849,024 | 7/1989 | Supra . | |
| 4,852,211 | 8/1989 | Stausak . | |
| 4,949,419 | 8/1990 | Kallenbach . | |
| 4,979,986 | 12/1990 | Hill et al. . | |
| 5,014,382 | 5/1991 | Kallenbach . | |
| 5,198,156 | 3/1993 | Middleton et al. . | |
| 5,418,995 | 5/1995 | Rice et al. | 15/1.7 |
| 5,421,054 | 6/1995 | Dawson et al. | 15/1.7 |
| 5,433,985 | 7/1995 | Atkins | 15/1.7 |
| 5,465,443 | 11/1995 | Rice et al. . | |

FOREIGN PATENT DOCUMENTS

| | | |
|---|---|---|
| 2355353 | 5/1975 | Germany . |

OTHER PUBLICATIONS

Copies of two photographs of a beige disc and bearing the handwritten notation "Jandy" (product shown available to one or more Applicants prior to Nov. 4, 1994).

Copies of two photographs of a blue disc and bearing the handwritten notation "Kreepy Krauley" (product shown available to one or more Applicants prior to Nov. 4, 1994).

A copy of one photograph of a black disc and bearing the handwritten notation "Baracuda" (product shown available to one or more Applicants prior to Nov. 4, 1994).

Copies of two photographs of a blue disc for a swimming pool cleaner (product shown available to one or more Applicants prior to Nov. 4, 1994).

*Primary Examiner*—David Scherbel
*Assistant Examiner*—Terrence R. Till
*Attorney, Agent, or Firm*—Dean W. Russell; Kilpatrick & Cody

[57] ABSTRACT

Discs for devices such as automatic swimming pool cleaners are disclosed. The discs incorporate one or more flutes, or raised areas (arched protrusions), extending generally radially from adjacent their central portions to their peripheries. The peripheries themselves, moreover, may include upturned areas (lips) between flutes, and both the discs and footpad may include ramped segments facilitating movement over obstacles extending from swimming pool surfaces.

11 Claims, 3 Drawing Sheets

FLUTED SWIMMING POOL CLEANER DISCS

FIELD OF THE INVENTION

This invention relates to discs for cleaners of liquid-containing vessels and more particularly to automatic pool cleaners having fluted discs for improved performance in swimming pools.

BACKGROUND OF THE INVENTION

U.S. Pat. No. 4,351,077 to Hofmann and U.S. Pat. No. 4,642,833 to Stoltz, et al., incorporated herein in their entireties by this reference, disclose automatic, water-interruption-type suction swimming pool cleaners having flexible annular discs. These discs are typically mounted near the inlets of the suction cleaners and designed to contact pool surfaces when in use. By doing so, the discs decrease the tendency of the cleaners to disengage from pool surfaces, particularly when the cleaners are negotiating transition regions between walls and floors.

U.S. Pat. No. 4,193,156 to Chauvier, also incorporated herein in its entirety by this reference, describes (at column 4, lines 5–55) an annular disc having numerous "concertina-like," "circumferentially spaced folds." These folds extend when their associated swimming pool cleaner encounters a transition region, purportedly "keeping the inflow of water into the mouth opening to a minimum." Other existing discs similarly are designed for improved adhesion to surfaces to be cleaned, thereby reducing fluid flow into the mouth of the cleaners.

SUMMARY OF THE INVENTION

The present invention provides alternative flexible discs for devices such as automatic swimming pool cleaners. Unlike the discs described above, the present invention incorporates one or more flutes, or curved raised areas (arched protrusions), therein. Each such flute extends generally radially from adjacent the central portion of the disc to its periphery, creating a direct fluid flow path from the periphery of the disc to the mouth of the associated cleaner. Doing so expands the cleaning area of the disc without concurrently enlarging its physical area, enhancing performance over conventional discs.

In particular, fluid flow rates into the cleaner mouth increase significantly in the fluted areas. This accelerated flow reduces the pressure (according to Bernoulli's equation) not only in the fluted areas themselves, but also beyond the periphery of the disc in the regions surrounding the openings provided by the flutes. This larger area of low pressure results in a greater area of the vessel being subject to cleaning for a given-sized disc, since the low pressure region draws debris toward the disc (the source of low pressure).

Certain embodiments of the present invention include dual flutes symmetric about a radius of the disc. Fewer or greater flutes may be included, however, consistent with the scope of the invention. Moreover, such flutes need not be of uniform width or depth, but rather may taper toward the central portion of the disc (thereby effectively funneling fluid from the periphery) and simultaneously decrease in depth. The boundaries of the flutes additionally may be either straight or curved as suitable or desired.

Additional features of the present invention include a curved, or upturned, lip between flutes. The lip, forming the leading edge of the disc, supplies an inclined surface for and sufficient rigidity to the disc to enable it to ride over various objects, including many drains, lights, valves, and nozzles, projecting from internal surfaces of pools. The disc underside also contains an integrally-formed ramped segment surrounding its (nominally circular) central aperture. This ramp likewise assists the pool cleaner in negotiating obstacles, supplying a smooth progression from the disc bottom to the bottom of the cleaner footpad (which the disc surrounds in use), which too may include a ramp.

Multiple openings through the disc enable fluid to pass from one surface of the disc to the other, maintaining a boundary fluid layer between the lower surface of the disc and the adjacent surface of the pool. These openings facilitate movement of the disc relative to the pool cleaner and allow dirt and debris to be entrained in the flow of fluid through the openings and in the boundary layer. Another embodiment of the present invention includes a multi-featured periphery and a non-circular central aperture.

It is therefore an object of the present invention to provide a disc incorporating one or more generally radial flutes extending to its periphery.

It is a further object of the present invention to provide a disc enhancing the performance of an automatic swimming pool cleaner through increasing its cleaning area by providing a larger low pressure region.

It is an additional object of the present invention to provide a disc having one or more upturned lips to facilitate negotiating obstacles.

It is yet another object of the present invention to provide a disc having an underside containing a ramped segment surrounding its central aperture.

It is, moreover, an object of the present invention to provide a disc including multiple openings therethrough, enabling fluid to pass from one surface of the disc to the other.

Other objects, features, and advantages of the present invention will become apparent with reference to the remainder of the text and the drawings of this application.

DETAILED DESCRIPTION

Figure 1:
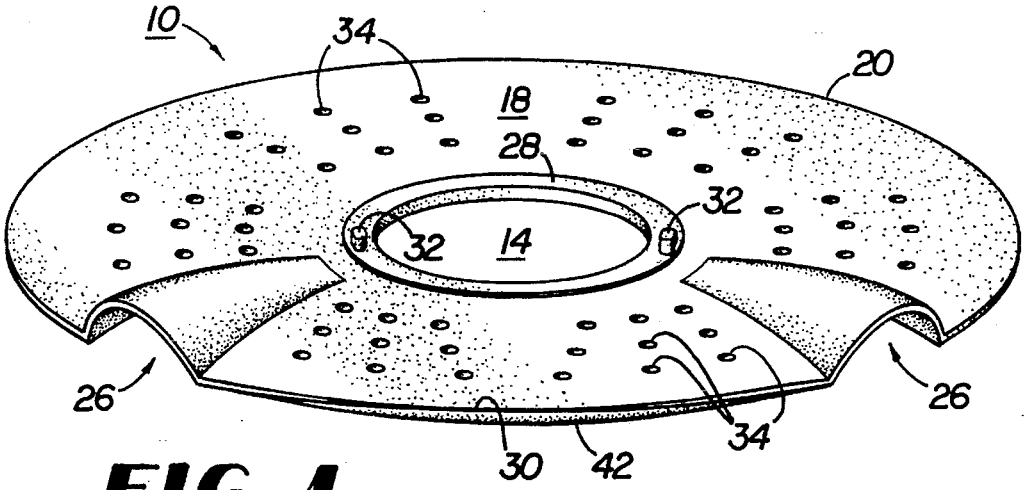
FIG. 1 is a perspective view of a disc of the present invention.
Figure 2:
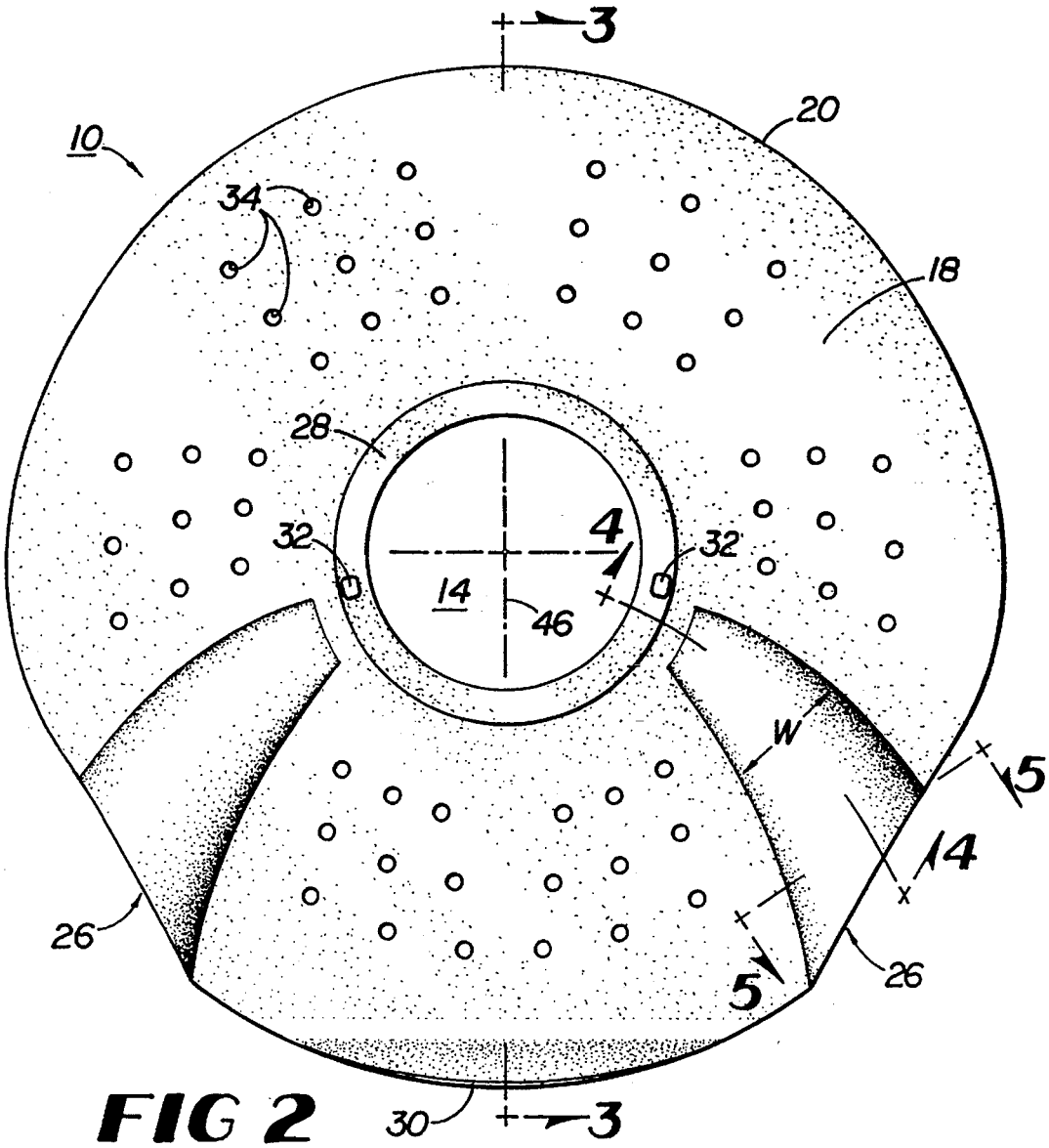
FIG. 2 is a top plan view of the disc of FIG. 1.
Figure 3:
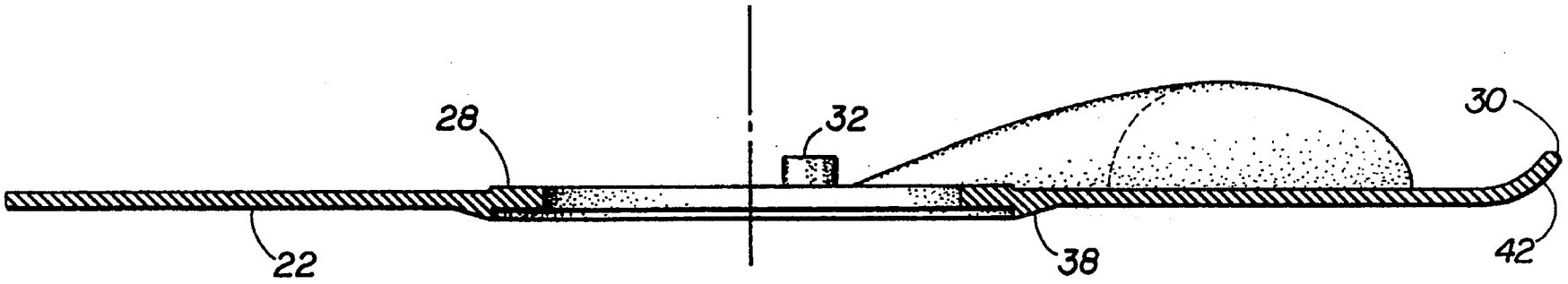
FIG. 3 is a cross-sectional view of the disc of FIG. 1 taken along lines 3—3 of FIG. 2.

FIGS. 1–5 illustrate disc 10 of the present invention. Disc 10 defines a central aperture 14, nominally circular, in which a footpad of an automatic swimming pool cleaner may be received, for example. Disc 10 also defines a generally planar upper surface 18, a periphery 20 and, as shown in FIG. 3, a lower surface 22. Extending upward from upper surface 18 are curved raised areas (arched protrusions), or flutes 26, which effectively expand the cleaning area of disc 10 without concurrently enlarging its physical area. Each flute 26 extends generally radially from adjacent the reinforced area 28 of disc 10 surrounding central aperture 14 to periphery 20, creating a direct path from the periphery 20 to the mouth of the associated cleaner for debris-laden fluid.

FIGS. 1–3 also detail the raised lip 30 of periphery 20. Located intermediate adjacent flutes 26, lip 30 provides a ramped portion of disc 10 (which may be of increased rigidity) to facilitate the disc 10 negotiating obstacles often projecting from interior pool surfaces. Pins or stops 32, which may be integrally formed with and project upward from the reinforced area 28 of disc 10, cooperate with portions of a footpad or other component to inhibit misorientation of disc 10. In use, lip 30 forms the leading edge of disc 10 as it and associated equipment move throughout a pool or other vessel, enabling the disc 10 to ride over objects encountered therein. Openings 34 through disc 10 enable fluid to pass between upper and lower surfaces 18 and 22 of disc 10 when in use, maintaining a boundary fluid layer between the lower surface 22 of disc 10 and the adjacent surface of the pool or other structure to be cleaned.

Figure 4:
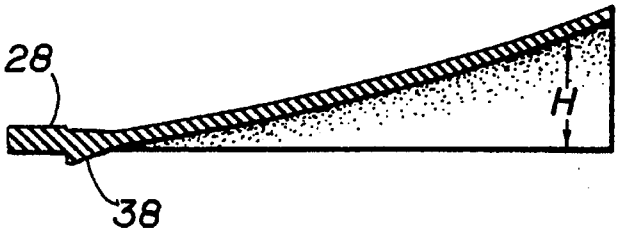
FIG. 4 is a cross-sectional view of the disc of FIG. 1 taken along lines 4—4 of FIG. 2.

Shown in FIGS. 3–4 is ramp 38, projecting from lower surface 22 of disc 10 and positioned concentrically about central aperture 14. Ramp 38 promotes a smooth transition between lower surface 22 and the bottom of a footpad (or other component) received by central aperture 14, facilitating unobstructed movement of a swimming pool cleaner associated with the footpad. FIG. 3 similarly discloses radius 42 existing between lip 30 and lower surface 22 of disc 10, providing a smooth transition therebetween and, as noted above, an inclined surface, or ramp, for negotiating obstacles.

In an embodiment of the invention consistent with FIGS. 1–5, flutes 26 are positioned symmetrically about a radial axis 46 extending through disc 10 from central aperture 14 to periphery 20. As shown in these figures, flutes 26 need not be of uniform width (W) or height (H), but rather may be widest and highest (i.e. protrude further) at periphery 20 and taper in width while decreasing in height toward reinforced area 28. As noted earlier, fluid flow rates into the cleaner mouth increase substantially in the fluted areas of disc 10. This accelerated flow creates a region of low pressure extending beyond periphery 20, increasing the effective cleaning area of the cleaner.

Although two flutes 26 are illustrated in FIG. 1, the number of flutes 26 is not necessarily critical to the invention. Consequently, disc 10 may include more or less than two flutes 26 as necessary or desired. Those skilled in the art will recognize, however, that including vast numbers of flutes 26 on disc 10 may ultimately diminish the effectiveness of the associated cleaner by reducing the quantity of the increased fluid flow through each to a negligible amount.

Figure 5:
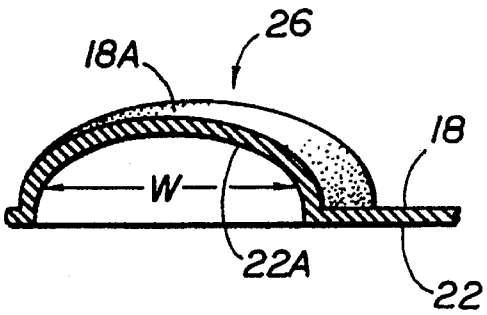
FIG. 5 is a cross-sectional view of the disc of FIG. 1 taken along lines 5—5 of FIG. 2.

FIG. 5 details selected characteristics of a portion of flute 26 near periphery 20. Whereas upper surface 18 and lower surface 22 generally define parallel planes, at flute 26 each extends upward above the plane formed by upper surface 18. These upwardly-extending surfaces 18A and 22A, while remaining approximately parallel at any particular location, no longer are planar but rather are curved. The result is an approximately semi-conical structure for flute 26 that, as shown in FIGS. 1–2, may be truncated adjacent reinforced area 28.

Figure 6:
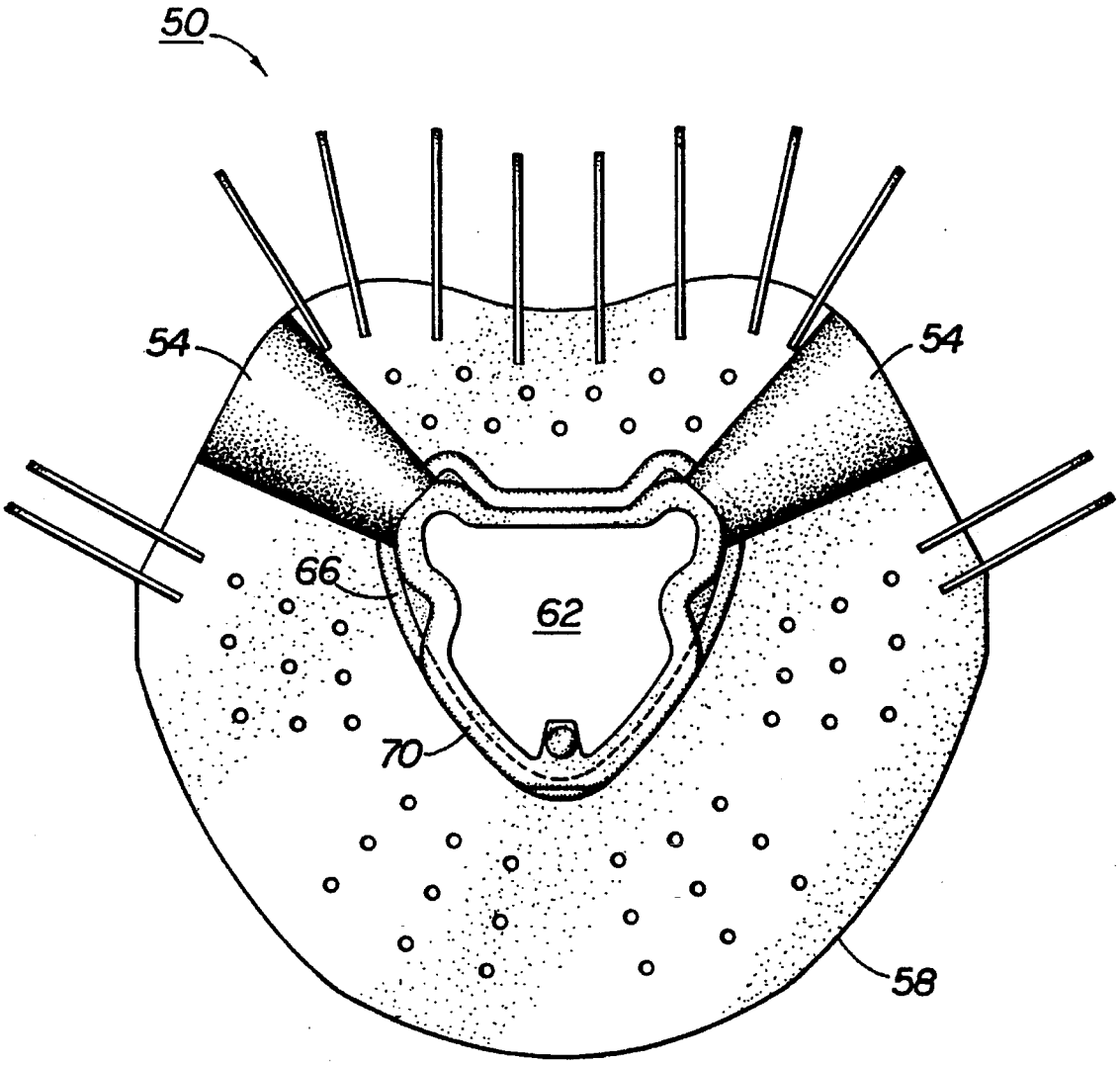
FIG. 6 is a top plan view of an alternate embodiment of a disc of the present invention.

FIG. 6 illustrates an alternate disc 50 of the present invention. Although including flutes 54 similar to disc 10, disc has a multi-featured periphery 58 differing in shape from periphery 20. Central aperture 62 of disc 50 additionally is configured differently than central aperture 14 of disc 10, with reinforced area 66 being more triangular than circular in nature. Defining central aperture 62 in this manner permits suitable attachment to the style of footpad 70 shown in FIG. 6. Doing so also alleviates any need for including stops 32 or other external orientation means to be present on disc 50.

The foregoing is provided for purposes of illustrating, explaining, and describing embodiments of the present invention. Modifications and adaptations to these embodiments will be apparent to those of ordinary skill in the art and may be made without departing from the scope or spirit of the invention.

What is claimed is:

1. A disc adapted for use as part of an automatic swimming pool cleaner, comprising:

a. an upper surface having a planar portion;

b. a lower surface;

c. a periphery including an upturned lip;

d. a first arched protrusion integrally formed with the upper surface and extending (i) upward above the planar portion of the upper surface and (ii) to the periphery; and e. means, comprising a central aperture, for receiving a portion of the automatic swimming pool cleaner.

2. A disc according to claim 1 in which the automatic swimming pool cleaner has a principal direction of movement, further comprising means for orienting the disc when the central aperture receives a portion of the automatic swimming pool cleaner so that the upturned lip forms the leading edge of the disc in the principal direction of movement.

3. A disc according to claim 2 further comprising a reinforced area surrounding the central aperture and in which the means for orienting the disc comprises a stop protruding from the reinforced area.

4. A disc according to claim 3 further comprising a plurality of openings through which fluid may pass from the lower surface to the upper surface when the automatic swimming pool cleaner is immersed in the fluid.

5. A disc according to claim 1 in which the upper surface defines a radial axis and further comprising a second arched protrusion, which first and second arched protrusions, are symmetric about the radial axis.

6. A disc according to claim 1 in which the first arched protrusion defines a width and height which are greatest at the periphery and decrease toward the central aperture.

7. A disc according to claim 6 in which at least a portion of the first arched protrusion is approximately semi-conical in shape.

8. A disc according to claim 7 further comprising a second arched protrusion of approximately truncated, semi-conical shape.

9. An assembly adapted to receive a footpad of an automatic swimming pool cleaner, comprising a molded plastic, flexible disc having a central aperture and comprising:

a. an upper surface having a planar portion;

b. a lower surface defining (1) a plurality of openings to the upper surface through which fluid may pass when the automatic swimming pool cleaner is immersed in the fluid and (2) an axis along a selected radius;

c. a periphery;

d. a reinforced area integrally formed with the upper surface and surrounding the central aperture;

e. a plurality of arched protrusions symmetric about the axis and extending upward from the upper surface, each arched protrusion (1) extending from adjacent the reinforced area to the periphery and (2) defining a width and height which are greatest at the periphery;

f. an annular ramp integrally formed with the lower surface and surrounding the central aperture; and means for orienting the disc about the footpad.

10. A disc adapted for use as part of an automatic device for cleaning debris-laden fluid contained in a swimming pool, comprising:

a. an upper surface having a planar portion;

b. a lower surface;

c. a periphery;

d. means, comprising a central aperture, for receiving a portion of the automatic swimming pool cleaner; and e. means, comprising an arched protrusion integrally formed with the upper surface and extending (i) upward above the planar portion of the upper surface and (ii) to the periphery, for inducing substantially increased flow of the fluid from the periphery toward the central aperture in use.

11. A disc according to claim 10 in which the arched protrusion defines a width and height which are greatest at the periphery and decrease toward the central aperture.

* * * * *